US009687021B2

(12) United States Patent
Mocelin et al.

(10) Patent No.: US 9,687,021 B2
(45) Date of Patent: Jun. 27, 2017

(54) SHED FOR CURING AND DRYING OF TOBACCO AND DEVELOPMENT AND PRODUCTION OF SEEDLINGS

(71) Applicant: Souza Cruz S.A., Rio de Janeiro (BR)

(72) Inventors: Riscala Mocelin, Cachoeirinha (BR); Jaime Menegasso, Cachoeirinha (BR); Eleandro Crestani, Cachoeirinha (BR); Iradi Pascoaloto, Cachoeirinha (BR); Armando Kulakowski, Cachoeirinha (BR)

(73) Assignee: Souza Cruz S.A., Rio de Janiero (BR)

( * ) Notice: Subject to any disclaimer, the term of this patent is extended or adjusted under 35 U.S.C. 154(b) by 0 days.

(21) Appl. No.: 14/762,748

(22) PCT Filed: Jan. 21, 2014

(86) PCT No.: PCT/IB2014/000181
§ 371 (c)(1),
(2) Date: Jul. 22, 2015

(87) PCT Pub. No.: WO2014/115028
PCT Pub. Date: Jul. 31, 2014

(65) Prior Publication Data
US 2015/0366261 A1 Dec. 24, 2015

(30) Foreign Application Priority Data
Jan. 24, 2013 (BR) ..... 2020130018762

(51) Int. Cl.
*F26B 25/12* (2006.01)
*A24B 1/02* (2006.01)
(Continued)

(52) U.S. Cl.
CPC ..... *A24B 1/02* (2013.01); *E04H 5/08* (2013.01); *F26B 3/283* (2013.01); *F26B 25/10* (2013.01); *F26B 25/12* (2013.01)

(58) Field of Classification Search
CPC .. F26B 3/00; F26B 3/283; F26B 21/00; F26B 23/00; F26B 25/00; F26B 25/12;
(Continued)

(56) References Cited

U.S. PATENT DOCUMENTS 646,218 A * 3/1900 Hollingsworth ..... A24B 3/04 131/302
1,853,423 A * 4/1932 Harris ..... A24B 3/04 131/303
(Continued)

FOREIGN PATENT DOCUMENTS

BR EP 2949838 A1 * 12/2015 ..... E04H 5/08
CA 1012862 6/1977
(Continued)

OTHER PUBLICATIONS

European Patent Office—International Searching Authority; Notification of Transmittal of the International Search Report and the Written Opinion of the International Searching Authority; Jun. 5, 2014; NL.

*Primary Examiner* — Stephen M Gravini
(74) *Attorney, Agent, or Firm* — McKee, Voorhees & Sease, PLC

(57) ABSTRACT

This utility model relates to a shed for the air drying and curing of tobacco and the growth and production of seedlings, comprising: (i) a plurality of columns (2) which can be positioned at spaced intervals; (ii) a structure (4) mounted on the said columns; (iii) a removable flexible roof (5) stretched over the said structure (4); (iv) removable flexible side panels (3) extending between the said columns; (v) fixing
(Continued)

elements (8) to attach the said side panels (3) and the flexible roof (5).

14 Claims, 4 Drawing Sheets

(51) Int. Cl.
*E04H 5/08* (2006.01)
*F26B 3/28* (2006.01)
*F26B 25/10* (2006.01)

(58) Field of Classification Search
CPC .... A24B 1/00; A24B 1/02; A24B 3/00; A24B 3/04; E04H 5/08
USPC ..... 34/201, 210, 218; 131/303; 432/500
See application file for complete search history.

(56) References Cited

U.S. PATENT DOCUMENTS 2,105,848 A * 1/1938 Touton ..... A24B 3/04 131/302
2,343,345 A * 3/1944 Touton ..... A24B 1/02 131/303
2,986,150 A 5/1961 Harold
3,450,192 A * 6/1969 Hay ..... F24F 5/00 126/628
3,866,334 A * 2/1975 Huang ..... A24B 1/02 126/629
3,935,648 A 2/1976 Cox
4,021,928 A * 5/1977 Johnson ..... A24B 1/02 131/302
4,069,593 A * 1/1978 Huang ..... F26B 3/286 126/617
4,490,926 A * 1/1985 Stokes ..... F26B 3/286 34/76
4,961,271 A * 10/1990 Butler ..... F26B 25/066 34/218
6,846,177 B1 * 1/2005 Hutchens ..... A24B 1/02 131/290
7,748,137 B2 * 7/2010 Wang ..... A01G 9/22 144/364
7,963,048 B2 * 6/2011 Pollard ..... F26B 15/12 110/315

FOREIGN PATENT DOCUMENTS

FR 2376921 8/1978
GB WO 2014115028 A1 * 7/2014 ..... E04H 5/08
KR 101320271 B1 * 10/2013

* cited by examiner

SHED FOR CURING AND DRYING OF TOBACCO AND DEVELOPMENT AND PRODUCTION OF SEEDLINGS

SCOPE

This utility model relates to a shed for the air curing and drying of tobacco plants which permits use of the space throughout the whole year, making it possible to pre-wilt tobacco and grow seedlings alternately.

BASIS OF THE UTILITY MODEL

At the present time the type of tobacco which is cured in air, for example Burley, is cured naturally, that is without a forced supply of air, in sheds of type: (a) the conventional type, of various sizes, length and number of layers of plants; (b) GB2, which are sheds 4 to 8 meters wide by 32 meters long with two levels of plants; (c) G3, which are sheds 8 meters wide by 32 meters long with three levels of plants; and (d) GB1, which are sheds 4 and 6 meters wide and 32 meters long having one layer of plants and a roof of conventional transparent plastic.

Processes for the curing and drying of tobaccos vary with the type of tobacco and the conditions required for each type. For example, Virginia type tobacco requires a curing process in which a forced and/or convected air supply and artificial heating are required to achieve the temperature required to cure it.

SUMMARY OF THE UTILITY MODEL

According to this utility model provision is made for a shed for the air drying and curing of tobacco and the growth and production of seedlings, comprising: (i) a plurality of columns (2) spaced at intervals; (ii) a structure (4) mounted on those columns; (iii) a removable flexible roof (5) stretched over the said structure (4); (iv) removable flexible side panels (3) which extend between the said columns; (v) fixing elements (8) to secure the said side panels (3) and the flexible roof (5).

The standard shed (1) according to this utility model comprises: (i) a plurality of columns (2) made of an appropriate material, for example, wood, concrete or metal, to support the protection for the sides (3) of the shed; (ii) a structure (4) made of appropriate material, for example wood, plastic, for example polycarbonate, or metal, to support the transparent roof (5) of the shed; (iii) a set of substantially horizontal supports (6) to support the supports (7) for the tobacco plants (FT) for pre-wilting, curing and drying, the said supports (7) being preferably provided as a system of rods or a system of wires; (iv) fixing elements (8) for the side protection (3) and the transparent roof (5) at the junction between the top of the plurality of columns (2*a*) and the lower part of the structure (4*a*) over the entire perimeter; and (v) a space (9) located on the floor of the shed to accommodate the containers for tobacco seedlings (PT).

BRIEF DESCRIPTION OF THE DRAWINGS

FIG. 1 illustrates an embodiment of a shed according to this utility model in a perspective view.

FIG. 2 shows the interior of the shed, detailing the internal fittings.

DETAILED DESCRIPTION OF THE UTILITY MODEL

Figure 1A:
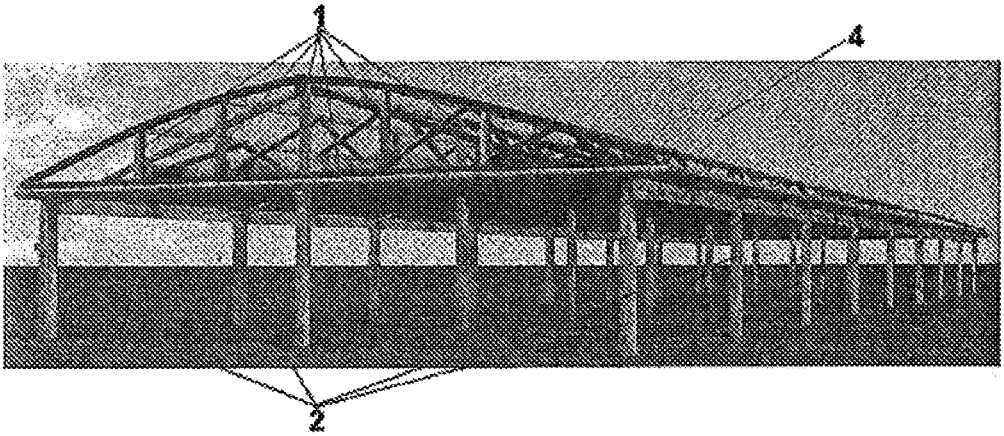
FIG. 1A showing the detail of the structure supporting the roof and the side protection for the shed.

All conventional types of sheds for air curing tobacco mentioned above, especially those of the GB1 type, have serious problems as regards the durability and difficulty of attaching the plastic roof. The damage caused by natural weather and the constant occurrence of storms with strong winds is causing producers to lose interest in constructing curing units of these types and also to not repair those already in existence.

In addition to this, the arrangement of the tobacco leaves when drying is a very important aspect for preventing the proliferation of microorganisms which degrade and prejudice the quality of the tobacco leaves which have to be subsequently processed to produce tobacco meeting market requirements. Moreover the environment in which tobacco curing and drying takes place has to have relative humidity and temperature conditions which ensure the quality of the tobacco being produced.

Necessarily, environments where tobacco curing and drying take place must be protected from the weather, and must be strong and durable to withstand extreme conditions, such as gusts of wind, hail, high exposure to the sun's rays and others which might destroy not only these structures, such as sheds, but also the harvest of tobacco leaves being processed.

Advantageously, sheds or other structures intended for the air drying and curing of tobacco leaves have to be located in rural areas, close to plantations. In addition to this they have to be made of materials which, although strong, are not very expensive and are suitable for practical structures which are easily built and do not require specialist labour, so that the expenditure of financial resources is consistent with the capabilities of the growers producing tobacco.

In the state of the art document CA1012862 describes a multipurpose rural structure which can be used for curing and drying or as a building for growing plants, using solar radiation. The structure is made of fiberglass (roof and sides, where the material at the sides may differ from that of the roof) to allow solar radiation to pass through. The advantage of this structure is its use at times when there are no tobacco leaves that have to be dried, optimising the construction cost of the structure. However, this structure is very complex to construct, requiring the use of technical and financial resources which are disproportionate to growers' capabilities. In addition to this, this known structure in the state of the art requires a greater amount of labour when carrying out the tasks of filling with tobacco leaves and tobacco plant seedlings and emptying them out.

Thus a shed which is at the same time consistent with the capabilities of tobacco growers and market requirements with regard to the quality of the tobacco produced is not at present known.

The object of this utility model is to provide a shed for the air curing and drying of tobacco with a combination of materials of excellent quality and aspects of construction offering better quality and durability of construction, in addition to creating a sustainable alternative with a view to reducing labour in the field and increasing the average age of growers. The shed according to the utility model has the advantages that: (a) it facilitates the stages of filling the shed with tobacco and emptying it, with both mechanised or manual harvesting systems, being more convenient for growers; (b) the cured tobacco leaves are of good quality and health as a result of increasing the rate at which plants are dried and removed, due to a higher temperature and better ventilation in comparison with conventional models, mainly during periods of greater humidity in the environment outside the shed; (c) the systems for attaching the roof and the side curtains which are designed to be more practical for erecting and constructing the curing and drying shed, not requiring specialist labour; (d) managing drying and curing is easy and convenient, given that the enclosure system using agricultural sheeting does not require labour for operating it, improving natural ventilation and curing conditions for the tobacco; and (e) the shed structure is close to the fields, reducing labour in the process of harvesting.

Because of the combined improvements in the structural elements and the aspects of the material introduced in this utility model the following advantages are achieved in comparison with the state of the art: the increase in ventilation and temperature within the shed brings about a substantial reduction in processing time, of approximately 25% in tobacco processing time (pre-wilting, drying and curing); and an increase in processing capacity (number of plants) of at least 32% as a result of it being possible to have more plants in the shed without losing the high quality of the tobacco processed.

The shed according to this utility model combines the simplicity required for construction and use in a rural area where there are tobacco plantations with the efficiency of a structure which can be used throughout the year, even during the period between harvests when no tobacco plants are available for drying and curing. During these periods the shed may be used to sow and grow tobacco plants to a suitable size for transplanting seedlings into the fields. It is also essential that the shed should be built of materials of a robustness and format which are suitable to withstand the weather.

Figure 1B:
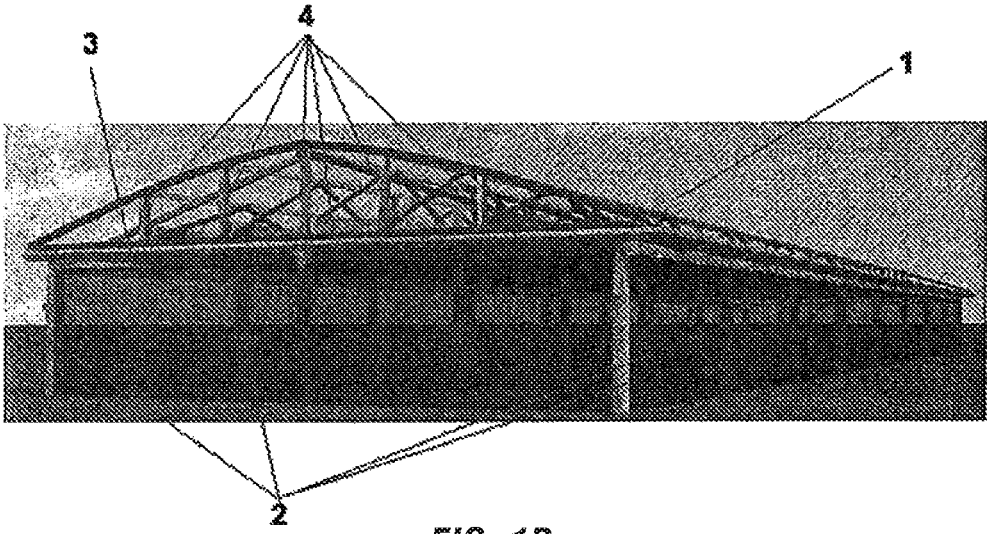
FIG. 1B also showing the side protection already in position.
Figure 1C:
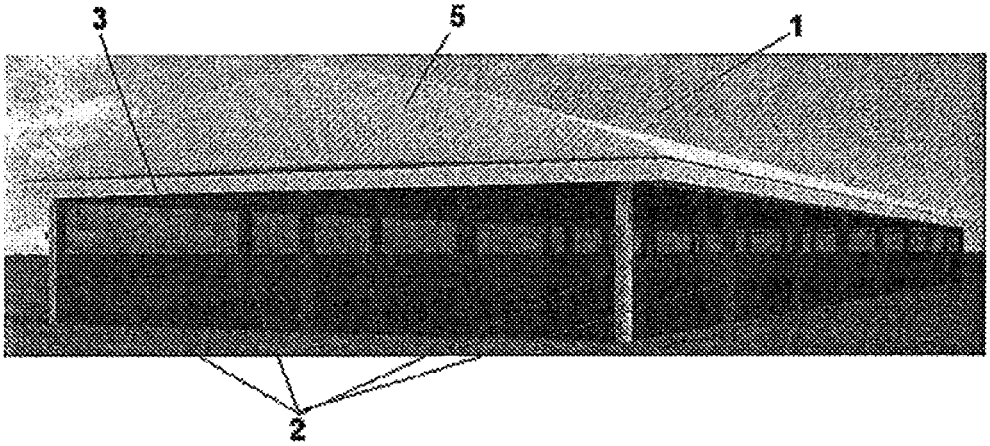
FIG. 1C also showing the side protection and the roof already in position.

As illustrated in FIG. 1 (FIGS. 1A, 1B and 1C), the shed (1) comprises a substantially rectangular structure formed of sides, of suitable width and length, for example not restricted to eight meters by thirty two meters, with the capacity for curing one layer of tobacco leaves (plants), these dimensions being adequate to increase the use of space to grow seedlings and carry out pre-wilting, curing and drying of tobacco, and compatible with the land area available close to the tobacco fields. The structure has a rectangular shape and substantially comprises pillars or columns (2) made of strong materials such as wood, metal or concrete, for example. The columns (2) are attached to the ground using appropriate means such as concrete bases and beams, metal clamps and the like to ensure durability and to act as a support for the side protection (3), which is preferably flexible and made of plastic material allowing natural ventilation, such as agricultural sheeting, with a shading factor of 65%, of high density polyethylene. The roof of the shed (1) is provided by means of a supporting structure (4) made of appropriate material such as wood or metal (for example aluminium sections); the said supporting structure being supported by the columns (2). The supporting structure (4) has the function of supporting the roof member, specifically a protective sheet (5) made of a material which is transparent to the sun's rays and is sufficiently strong to withstand unfavourable climatic conditions such as the laminated high density polyethylene sheeting available on the market under the name of the Solarig® brand. The curvature of the roof is provided by the construction of the supporting structure (4), using a central line or ridge piece (as detailed in FIG. 1C) as a base and with two further purlins (see FIG. 1C) between the ridge piece and the sides, the said ridge piece and purlins being made of wood or metal as appropriate. These ridge pieces and purlins act as a support for the laminated roof sheeting (5). The supporting structure (4) also comprises two front and rear scantlings or beams (end-members), also made of wood or metal and of sufficient thickness to support the load of the roof. Additionally, as illustrated in FIG. 1A, the width of the roof of the shed is preferably greater than the width of the sides (along the largest dimension) thus creating a "border" offering more protection and ventilation for the material being processed. The advantage of this supporting structure is that if the laminated sheeting (5) is replaced as a result of damage caused by climatic events it will not be necessary to replace the aluminium sections or the fixing springs for the sheeting.

The shed according to this utility model constructed in this way, that is with a roof and side protection supported by columns or pillars which provides the shed with resistance to the weather, is provided within with a set of substantially horizontal supports (6) to permit the tobacco plants undergoing processing, which includes pre-wilting, drying and air curing, to be positioned substantially vertically. This set of supports (6) supports rods to which the tobacco plants are attached.

Figure 2A:
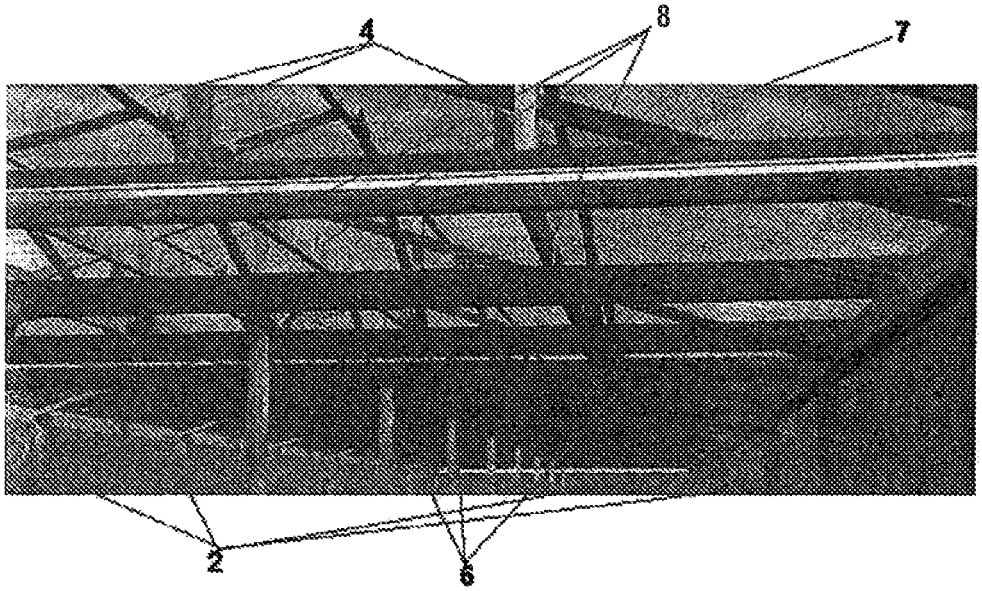
FIG. 2A illustrates the arrangement of the tobacco leaves (plants) (TB) on the system of rods.
Figure 2B:
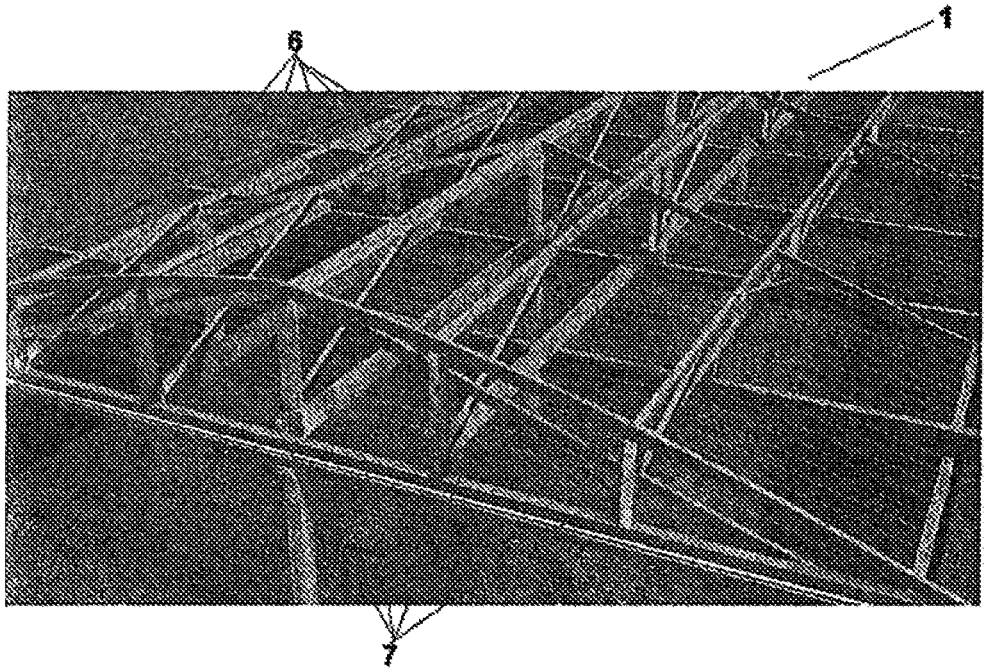
FIG. 2B illustrates the arrangement of the tobacco leaves (plants) (TB) on the system of wires.
Figure 3:
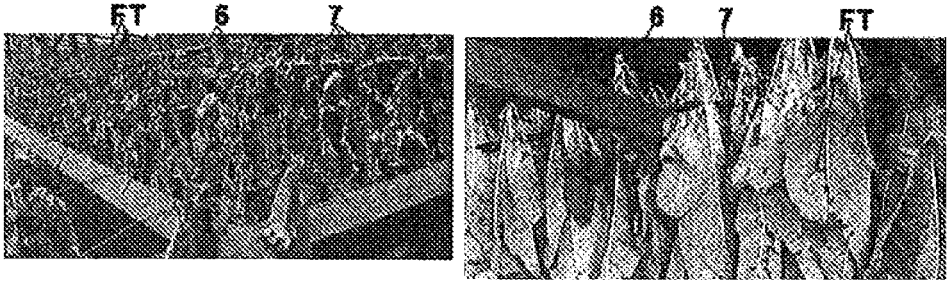
FIG. 3 illustrates application of the shed according to the utility model for the air drying and curing of tobacco leaves (wire system) and for the prewilting of tobacco leaves (rod system).

Plants are positioned in two ways, one with the plants attached to rods, placing for example 5 to 6 rods with 6 plants per square meter of floor space, totalling an average of 33 plants per square meter of floor space (5.5 rods with 6 plants) (see FIG. 2A). The other arrangement uses a system of wires located at a distance of approximately 18 cm from each other, on which the plants are attached to the wire by means of a "notch" made in the base of the plant, placing for example 6 plants per linear meter of wire, totalling 33 plants per square meter (see FIG. 2B). Filling of the shed is begun at one end, filling it completely until it is full. As shown in FIG. 3, the work of drying and curing the tobacco leaves (FT) (on the left) or pre-wilting them (on the right) can be carried out in the shed.

Figure 4:
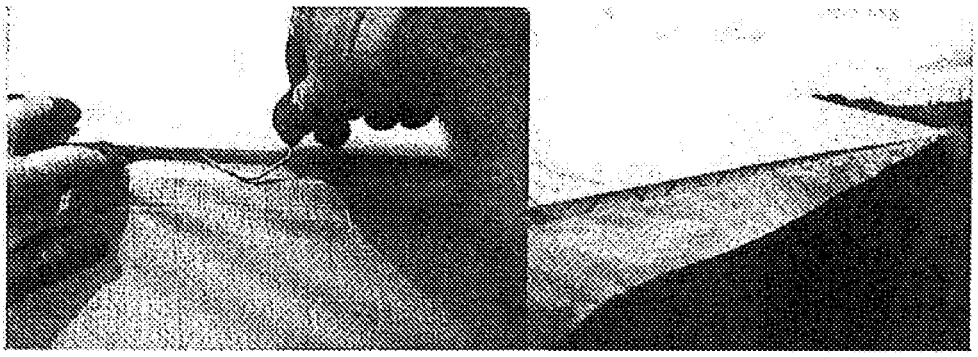
FIG. 4 shows attachment of the roof using a wooden edging piece.

The roof (5) is attached using a wooden edging piece, for example, attached to the sides, to which sections of metal, for example, aluminium, are attached (see FIG. 4) with screws for wood or other suitable rust-resistant material. The roof is attached to the aluminium section by a steel wire spring which engages the channel in the said section. The purpose of this arrangement is not only to improve appearance and provide greater durability and strength for the material, but also to make it easy to replace the roof without interfering with the main structure of the building.

Figure 5:
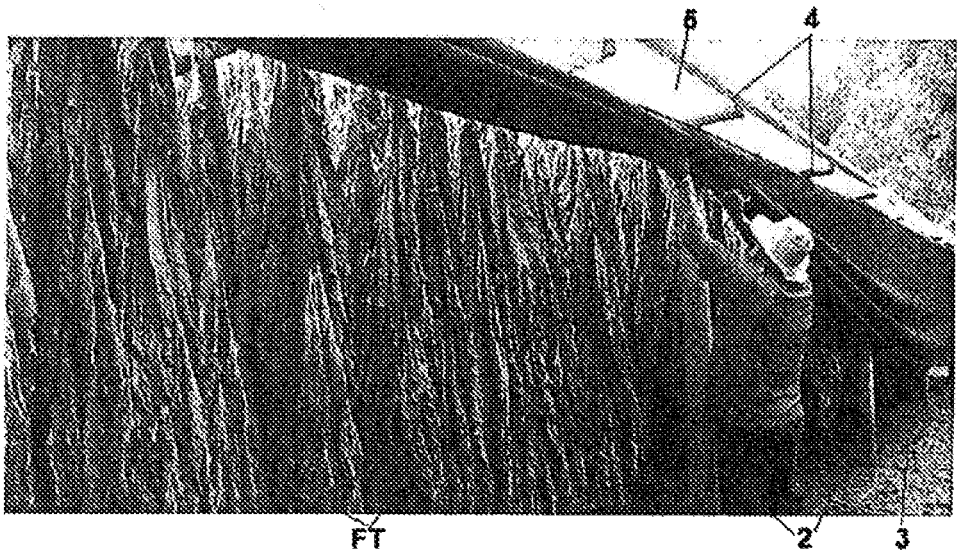
FIG. 5 shows the detail of the attachment of the side protection to the fittings supporting it.

The side protection or enclosure (3) is made of a material which allows some of the light to pass through and provides natural ventilation within the shed, for example 65% agricultural sheeting, preferably attached by wire (as detailed in FIG. 4), nylon catches and clips, and may be wholly fixed on one side and able to move on the other side to facilitate filling the shed with tobacco, as illustrated in FIG. 5. With this arrangement the system for enclosing the sides of the standard shed, made of 65% agricultural sheeting for example, has a width of two meters, for example. Thus the sheeting remains fixed and unable to move on one side and at one end, being attached by for example three wires, to each of which it is secured by a clip. Nylon clips are used to attach the sheeting to the wires. On the other side and at the other end the sheeting can move upwards to allow tobacco to be filled and removed when it is cured.

Attachment of the metal sections, for example aluminium, to the sides is brought about by means of suitably spaced screws, for example 60 by 60 centimeters, using wood screws on a metal edging piece attached to the ends of the cross-members by large nails (for example 23×60). At the end-members the sections are attached to the cross-members.

As shown in FIG. 1A, the sides have a 25 cm overhang on each side, which is achieved by extending the cross-members. When stretched over, the laminated roof sheeting (5) remains attached to the aluminium section through a steel wire spring which engages the channel in the section together with the laminated sheeting, keeping it held and stretched.

Figure 6:
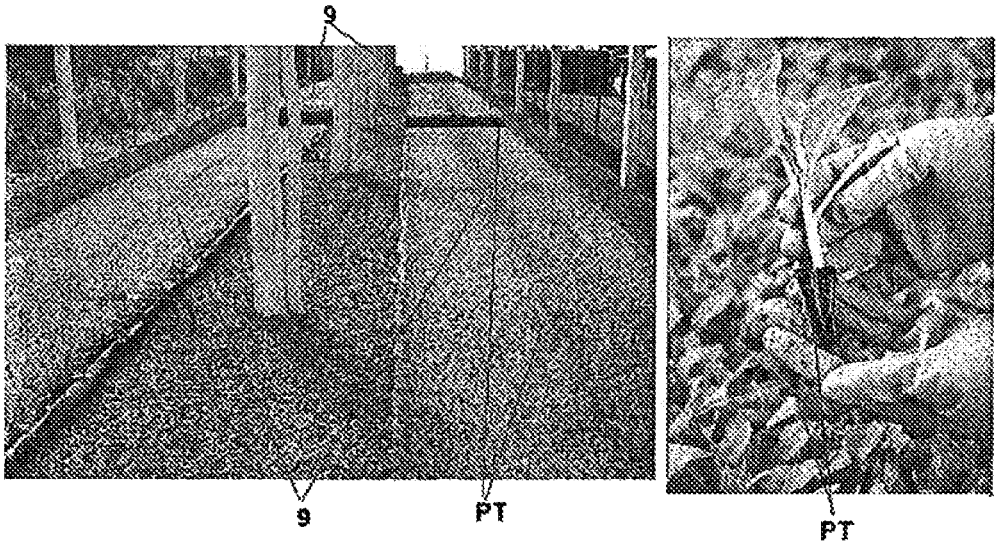
FIG. 6 illustrates application of the shed according to the utility model for sowing and growing tobacco plants.

As shown in FIG. 6, the floor of the shed according to the utility model is used for another purpose, that is sowing and growing of tobacco seedlings arranged in a layer. The seedlings are produced during a period of 60 to 70 days and then these seedlings are transplanted into the fields. After harvesting, when the plants have already grown to an ideal stage of maturity, they are collected and placed in the shed to carry out pre-wilting, curing and drying of the tobacco. These two activities (sowing/growing of the seedlings and pre-wilting/drying/curing of the tobacco leaves) are carried out at alternate times. Thus the internal structure of the shed in which tobacco is cured and dried is permanent. If seedlings are produced, only the trays and the plastic used for the beds is removed when the seedlings are ready to be transplanted, and these are replaced for the next cycle of seedling production.

The seedlings are produced according to the Float system on isopor or plastic trays.

After curing of the tobacco plants is complete, the shed is emptied, the plants being removed manually for picking apart, separating and bundling the tobacco.

Despite the fact that particular embodiments have been described, these have been presented only as an example and there is no intent to restrict the scope of protection. In fact the new embodiments described here may take a variety of other forms; but various omissions, replacements and changes in the form of the embodiments described here may be made without going beyond the scope of the utility model.

The invention claimed is:

1. A shed for the air curing and drying of tobacco and for growing and producing seedlings comprising:

a plurality of columns positioned at spaced intervals;

a structure mounted on the said columns;

a removable flexible roof stretched over the said structure;

removable flexible side panels extending between the said columns; and fixing elements to attach the said side panels and the flexible roof wherein said shed allows for the air curing and drying of tobacco as well as for growing and producing seedlings.

2. The shed according to claim 1, further including a set of substantially horizontal supports for substantially vertically positioning the tobacco plants which will be processed is provided within the shed.

3. The shed according to claim 1, wherein the material for the plurality of columns is selected from the group comprising wood, concrete or metal.

4. The shed according to claim 3, wherein the material for the plurality of columns is concrete.

5. The shed according to claim 1, wherein the material for the structure is selected from the group comprising wood, plastic or metal.

6. The shed according to claim 5, wherein the material for the structure is wood.

7. The shed according to claim 1, including a set of supports which act as a support for the supports for tobacco leaves for pre-wilting, curing and drying.

8. The shed according to claim 1, including supports for the tobacco leaves which are provided as a system of rods or a system of wires.

9. The shed according to claim 1, wherein the fixing elements are positioned at the junction between the top of the plurality of columns and the bottom of the structure along an entire perimeter of the structure.

10. The shed according to claim 1, including protection for the sides of the shed which includes a plastic material with a partial passage of light and natural ventilation.

11. The shed according to claim 10, wherein the said plastic material is about 65% agricultural sheeting.

12. The shed according to claim 1, wherein the said roof is transparent to the sun's rays and is made of laminated plastic material.

13. The shed according to claim 12, wherein the plastic material is high density polyethylene.

14. The shed according to claim 1, wherein the shed defining a space is provided as a bed.

* * * * *